US006877642B1

(12) United States Patent
Maddox et al.

(10) Patent No.: US 6,877,642 B1
(45) Date of Patent: Apr. 12, 2005

(54) WALL-MOUNTED DISPENSER FOR LIQUIDS

(75) Inventors: Jeffrey T. Maddox, Hudson, OH (US); Rexford R. Mast, Wooster, OH (US); Robert H. Yeager, Twinsburg, OH (US)

(73) Assignee: Joseph S. Kanfer, Richfield, OH (US)

( * ) Notice: Subject to any disclaimer, the term of this patent is extended or adjusted under 35 U.S.C. 154(b) by 0 days.

(21) Appl. No.: 09/478,240

(22) Filed: Jan. 4, 2000

(51) Int. Cl.[7] ..... B67D 5/006

(52) U.S. Cl. ..... 222/183.3; 222/105; 222/325; 222/153.03

(58) Field of Search ..... 222/105, 106, 222/181.3, 181.2, 183, 321.8, 325, 153.09, 153.03, 207, 154

(56) References Cited

U.S. PATENT DOCUMENTS 4,741,461 A * 5/1988 Williamson et al. ..... 222/181
5,207,355 A * 5/1993 Thomsen ..... 222/95
5,248,066 A * 9/1993 Olson et al. ..... 222/105
5,265,772 A 11/1993 Bartasevich et al. ..... 222/214
5,443,236 A 8/1995 Bell et al. ..... 248/311.3
5,465,877 A 11/1995 Bell et al. ..... 222/181.2
5,573,132 A 11/1996 Kanfer et al. ..... 220/4.23
5,625,659 A 4/1997 Sears ..... 377/21
5,944,227 A 8/1999 Schroeder et al. ..... 222/144.5
6,131,773 A * 10/2000 Wade et al. ..... 222/153.02
6,152,330 A * 11/2000 Polan ..... 222/156

* cited by examiner

*Primary Examiner*—Gene Mancene
*Assistant Examiner*—M A Cartagena
(74) *Attorney, Agent, or Firm*—Renner, Kenner, Greive, Bobak, Taylor & Weber

(57) ABSTRACT

A dispenser for dispensing liquid from a collapsible bag has a back plate and a cover hingedly attached thereto for movement between open and closed positions. The back plate carries a bag retainer and pump support which receives the bag which, in turn, carries a collapsible dome-type pump on its front surface adjacent its bottom edge. The pump includes a transparent collapsible dome and the dispenser cover includes a push bar for collapsing the dome to expel material. The push bar also has a clear window overlying the collapsible dome when the cover is closed.

26 Claims, 7 Drawing Sheets

61a
60
50
62
63
61
51
62a
62a
52a
52
82a
22
83
87a
87
80
82a
83a
82b
84a
83
84
87a
81
83a
87
82
83c
83b
83c
84a
83b
84

WALL-MOUNTED DISPENSER FOR LIQUIDS

RELATED PATENT APPLICATIONS

None.

FIELD OF THE INVENTION

This invention relates in general to liquid dispensing assemblies and relates in particular to wall-mounted dispensers for liquids.

BACKGROUND OF THE INVENTION

It is known in the art to dispense soaps, lotions, conditioners, and other liquid substances of that general nature, in various ways. These include freestanding pump- and aerosol-type containers or bottles, countertop-mounted pump-type dispensers and wall-mounted-type dispensers.

This invention relates particularly to wall-mounted dispensers of which there are a variety known to the art.

In general, wall-mounted dispensers for material of this type include a back plate and cover which is capable of being opened to permit the dispenser to receive replaceable cartridges or refill packages with the dispenser being a more or less permanent installation in areas such as lavatories, restrooms, food handling areas, etc.

One general type of wall-mounted dispenser which has achieved considerable popularity in recent years is one in which the refill cartridge or package is the bag-in-box type. These generally include a collapsible bag which contains the material and which is itself received in a box made of cardboard or some similar material. The box is capable of being inserted onto a shelf in the interior of the dispenser and then partially opened to expose a tube which is in fluid communication with the bag and which constitutes the liquid dispensing pump of the assembly. This tube carries a nozzle on its distal end which is positioned in the dispenser so as to dispense the material onto the hand of the user when the pump is activated. These dispensers generally have a pivoting pressure bar which can be engaged by the hand of the user to apply pressure on the tube/pump, either by pushing against or pulling against the tube to thus dispense the material through the nozzle.

Examples of patent prior art involving this general method of dispensing can be seen in Bartasevich U.S. Pat. No. 5,265,772; Bell U.S. Pat. No. 5,443,236; Bell U.S. Pat. No. 5,465,877; Sears U.S. Pat. No. 5,625,659; and Schroeder U.S. Pat. No. 5,944,227 and many others.

While dispensing arrangements of this type have proved generally satisfactory, it is believed that certain improvements can be made thereto.

For one thing, it is believed desirable to reduce the force required to actually pump material from the cartridge or reservoir in order to render the unit more user friendly.

For another thing, it is believed desirable to be able to ascertain when the refill requires replacement without having to open the dispenser. To that end, many of these dispensers have sight windows disposed in the cover so that one can view at least a part of the bag from the outside of the dispenser with the cover closed. The difficulty is that, in practice, it is not really possible to obtain a good view through these windows for several reasons. One is that it is generally not possible to position the sight windows low enough down on the cover to accurately ascertain when the refill unit is nearly out of material because of the pumping mechanism usually employed. That is, the tube-type pumps extend below the bag or cartridge so that the window is positioned above the bottom of the bag. Another is that the interior of the dispenser is unilluminated so that it is quite difficult to see into the interior of the dispenser. Finally, as the bags empty, they tend to collapse and wrinkle so that the view of the contents is further impaired. That is, the optimum would be for the window to rest against a relatively flat surface which is not possible once the bag begins to empty.

Inasmuch as many of these dispensers are located in public or commercial establishments and are refilled by maintenance people, it would save considerable time, and thus considerable expense, to provide a means whereby maintenance personnel can, at a glance, without opening the dispenser, ascertain whether refills are required.

It is also the practice with dispensers of this type to fill them with different materials from time to time. That is, the dispenser may, on occasion, contain soap and on another occasion contain lotion, for example. Furthermore, multiple dispensers containing different materials may be located in proximity to each other. Because it is desirable that the end user know precisely the material which he or she is going to receive upon activation of the pumping mechanism of the dispenser, it is believed desirable to insure that a given dispenser can be filled only with refills intended for that dispenser and containing the appropriate material. It is, therefore, believed to be desirable to provide a means for insuring that only the correct refill can be placed into any given dispenser.

Also, with the bag-in-box-type replacement cartridge, the box necessarily is a cubical item occupying a given amount of space. It has been found then that, in shipping quantities of these replacements, considerable space in the shipping container is wasted because of the fairly rigid characteristics of the boxes and it is thought to be desirable to be able to eliminate the box and simply ship collapsible bags of fluid material which makes it possible to ship a far greater volume of actual material in a container of a given size. This also makes it possible to more efficiently utilize the space within the dispenser.

Thus, it has been found that a bag retainer and pump support can be provided in conjunction with the back plate of the dispenser whereby the bag, which, of course, has no fixed shape, can be employed as the refill cartridge itself.

Also, inasmuch as these dispensers are mass produced, it is obviously desirable to provide a dispenser which can be easily and economically assembled. To that end, it has been found that, by providing a unique hinge structure, the base cover and bag retainer and pump support can be quickly and easily snapped together and, once assembled and mounted on the wall, will provide improved resistance to vandalism.

Finally, given that the dispensers are generally durable and securely fixed to the wall, it is thought to be desirable to increase the volume of material available after each refill operation. With the conventional tube/pump arrangement, a significant percentage of the interior space in the dispenser is devoted to accommodating the pumping mechanism. Therefore, it is believed desirable to provide a more compact pumping mechanism located on the lower front surface of the bag so that virtually all of the interior of the dispenser can be utilized to store material.

SUMMARY OF THE INVENTION

It has been found that more efficient shipping and handling of replacement cartridges can be achieved by providing a dispenser having a pocket formed by a bag retainer and pump support with side and front walls attached to and projecting from the base or wall-mounting plate of the dispenser and which is capable of accommodating a collapsible bag of material without the need for providing a supporting box therearound. Such a bag retainer and pump support will also serve to protect the bag from pinching or puncture as the dispenser is opened and closed.

It has also been found that provision of a collapsible dome-like pump affixed adjacent the bottom of the bag on the front surface thereof will permit the same refill quantity to be placed in a dispenser having a lesser overall dimension because of the fact that the space normally occupied within the dispenser by the elongate tube/pump can be eliminated, thereby rendering the overall dispenser more efficient by storing a greater quantity per refill.

It has further been found that it is possible to facilitate the ease and accuracy of ascertainment of the condition of the refill by utilizing a pump of this nature adjacent the bottom of the bag and providing it with a clear, transparent collapsible dome and providing a pressure or push bar on the cover which likewise has a transparent member juxtaposed over the pump so that, without opening the container, one can ascertain the amount of material remaining in the bag and whether or not the cartridge is due for replacement. It has been found that this feature also has the advantage of permitting the user to view the material to be dispensed in the event it is color-coded to identify it as a soap, lotion, etc.

Utilization of such a collapsible dome-like pump also reduces the pressure required to activate the pump.

It has also been found that misfilling of a given dispenser can be avoided by providing a plate with a contoured aperture and a nozzle on the pump of the refill having a complemental contour so that it can be assured that only the proper refill cartridge will be placed in the appropriate dispenser. This arrangement also insures secure and accurate seating of the pump.

Accordingly, production of an improved wall-mounted dispenser for liquids of the character described becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
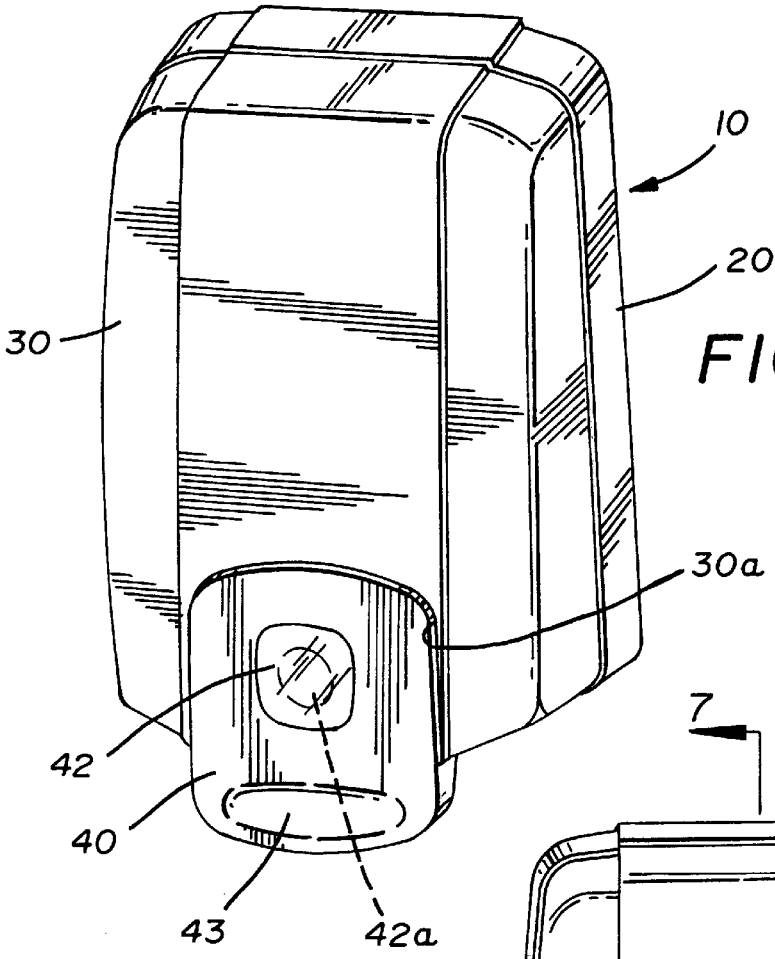
FIG. 1 is a perspective view showing our new liquid dispenser.

Referring then to FIGS. 1 through 4 of the drawings, it will be seen that the improved dispenser, generally indicated by the numeral 10, includes a back plate 20, a cover 30, and a pressure or push bar 40.

The cover 30 is hingedly connected to the back plate 20, as at 21, in a unique fashion, as will be described below, and is capable of being latched into place in the closed position shown in FIGS. 1 through 3 of the drawings. The cover 30 is, of course, also capable of being rotated away from the back plate 20 by means of the hinge 21, as is shown partially in FIG. 8 of the drawings, to enable the cartridge or bag of material to be replaced as required.

Figure 2:
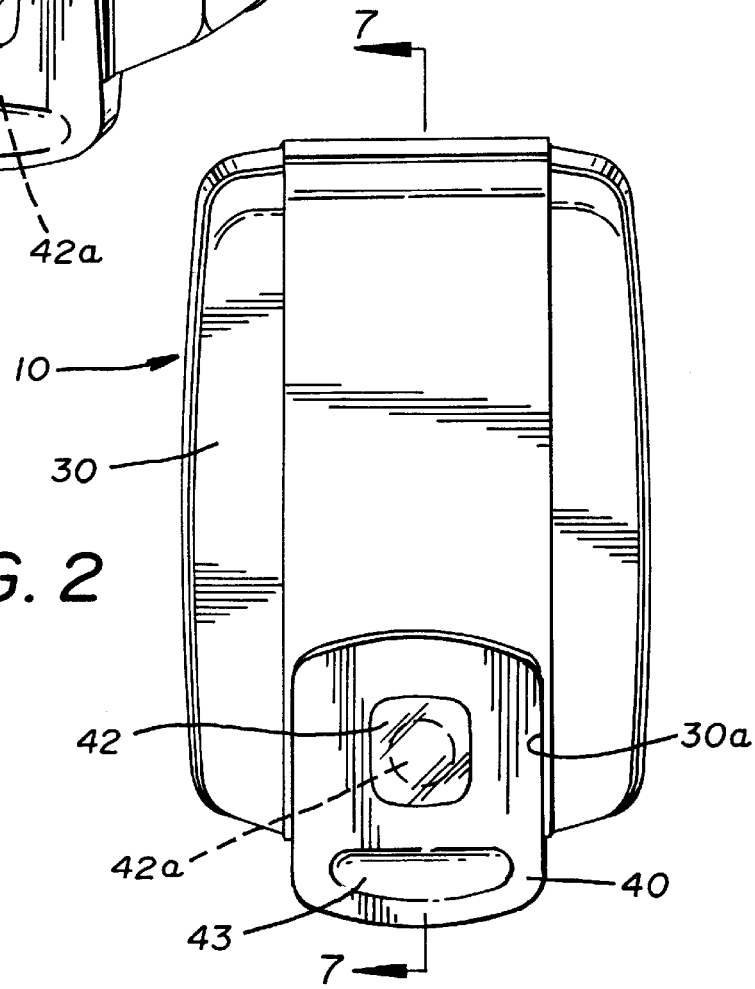
FIG. 2 is a front elevational view thereof.
Figure 3:
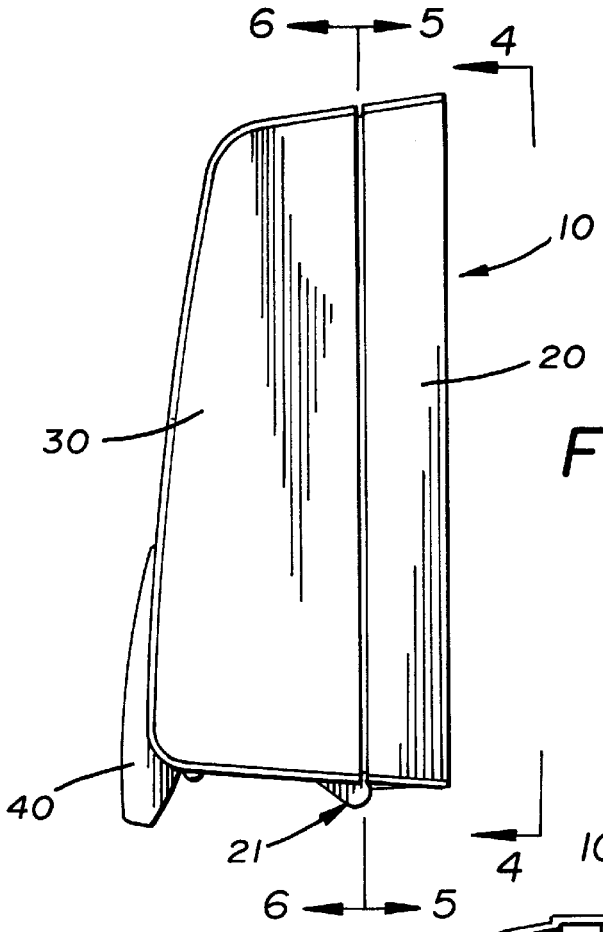
FIG. 3 is a side elevational view thereof.
Figure 4:
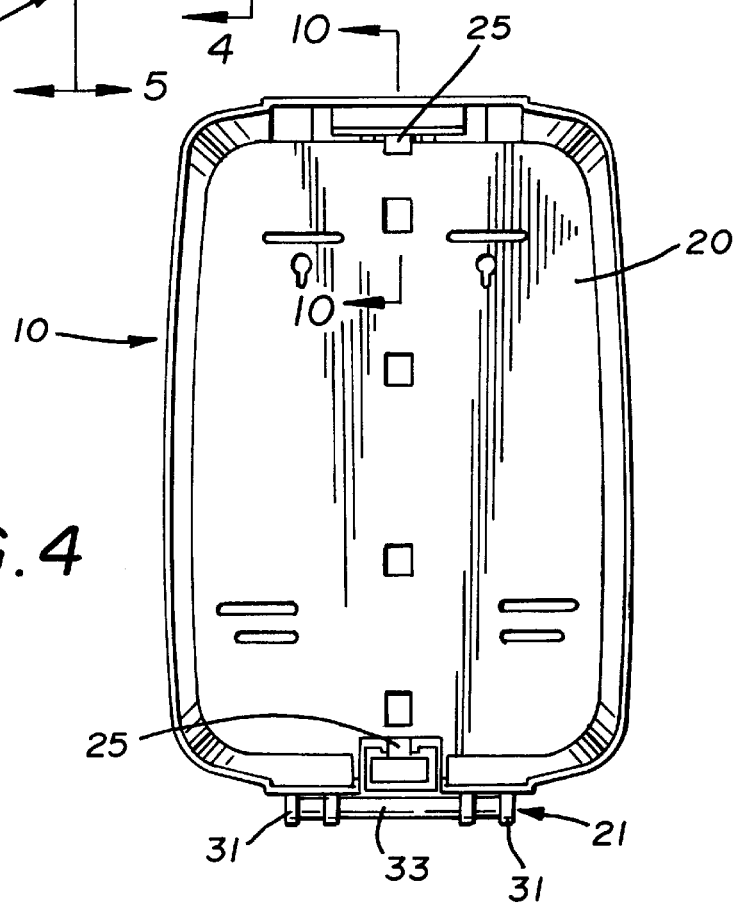
FIG. 4 is a rear elevational view thereof.
Figure 5:
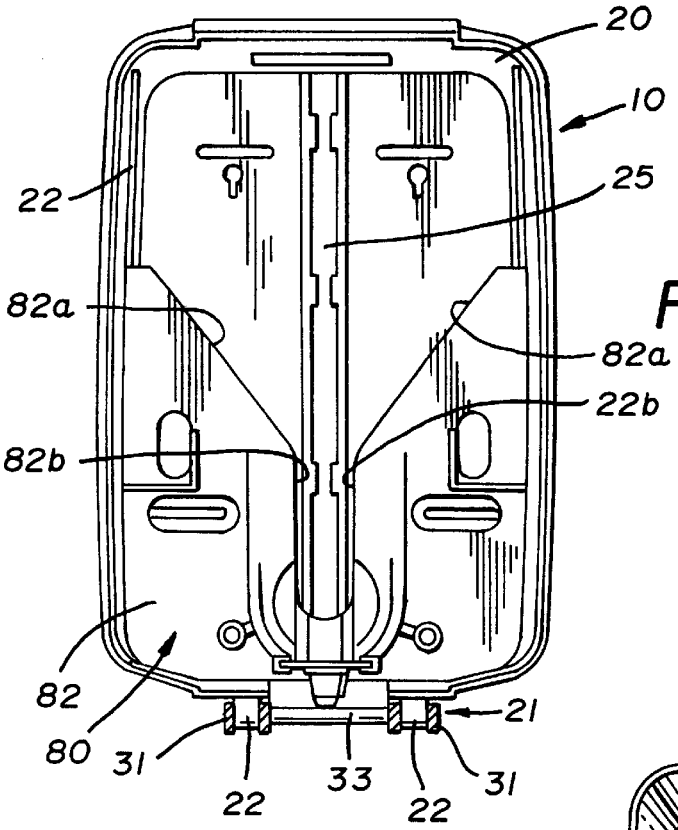
FIG. 5 is a sectional view taken along the line 5—5 of FIG. 3.
Figure 6:
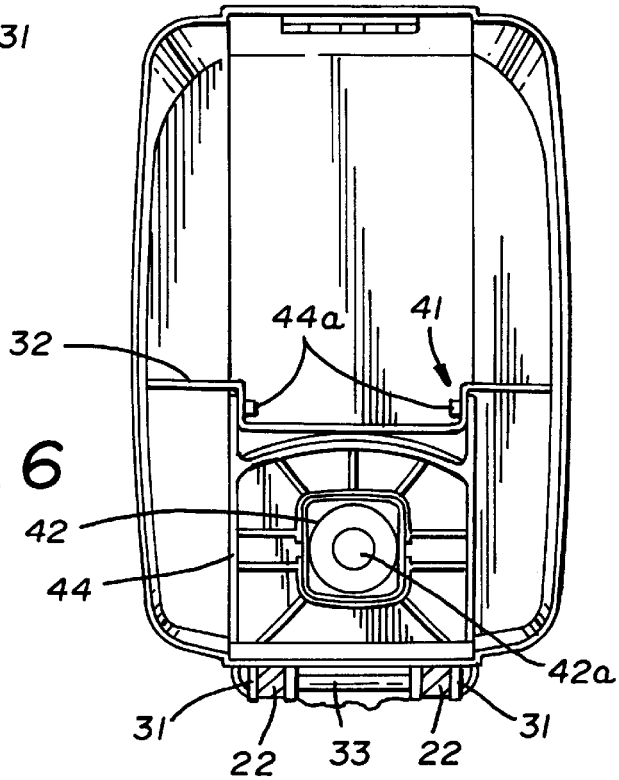
FIG. 6 is a sectional view taken along the line 6—6 of FIG. 3.
Figure 7:
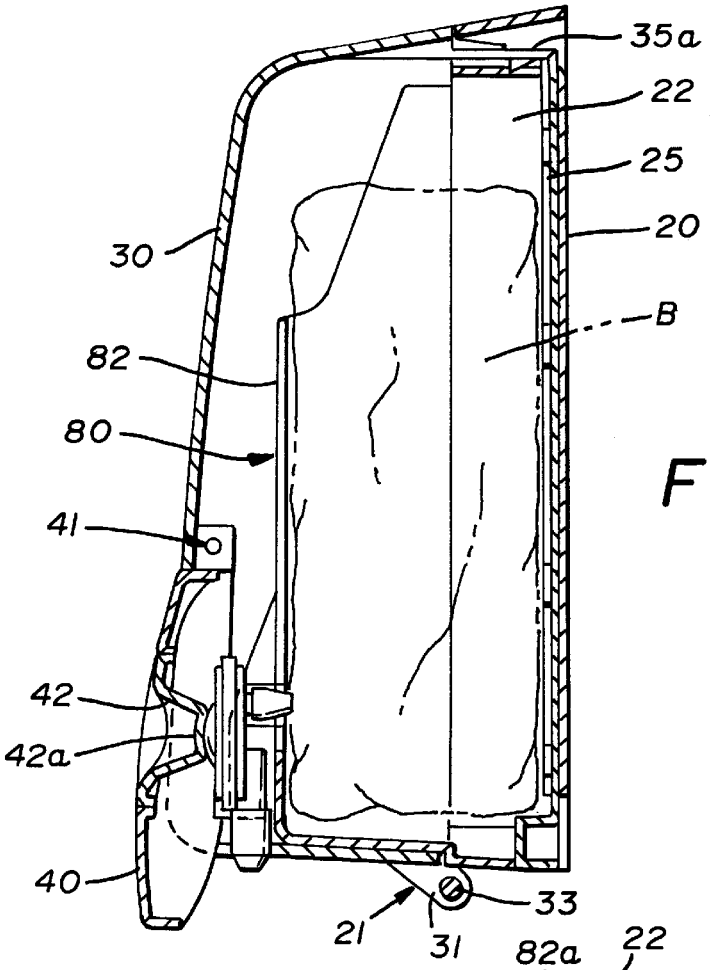
FIG. 7 is a sectional view taken along the line 7—7 of FIG. 2.

Referring to FIGS. 1, 2 and 7 of the drawings, it will be seen that the cover 30 has an opening 30*a* adjacent its lower edge and that the pressure or push bar 40 is received within this opening and hinged to the interior of the cover, as at 41. To that end, referring to FIG. 12 of the drawings, it will be seen that the pressure or push bar 40 has interior walls 44 which terminate in stub shafts 44*a*, 44*a*, and that the cover has a support bar 32 which is perforated so that the pressure or push bar can be snapped into place. The pressure or push bar being thus hingedly attached is capable of being moved toward and away from the back plate 20 when the cover 30 is in the closed position by engagement by the heel of the hand of the user. Such movement will cause a predetermined amount of the contents to be deposited on the hand of the user as will be described.

The pressure or push bar 40 also has a depressed frustoconical portion 42 which, in the preferred embodiment of the invention, is fabricated from a clear, transparent material and terminates in a concave wall 42*a* for purposes which will be described more fully below.

If desired, pressure or push bar 40 may also be provided with an offset area 43 for engagement by the heel of the hand of the user.

Referring particularly to FIGS. 5, 8, 9 and 12, it will be seen that a bag retainer and pump support 80 is provided for interconnection with the cover 30 and back plate 20. This bag retainer and pump support includes a peripheral wall 81 and a front wall 82. It will be seen that when this bag retainer 80 is snapped onto back plate 20, as can be seen, for example, in FIGS. 8 and 9, it serves to form a pocket for receipt of a bag B (see FIG. 7) containing the material to be dispensed, as well as means for locating and supporting pump 60. If desired, the bag retainer and pump support 80 could also be formed integrally with the back plate.

Still referring to FIGS. 7, 8 and 9, it will be seen that the front wall 82 of the bag retainer and pump support 80 has a central opening formed by downwardly tapering edge surfaces 82*a* and downwardly extending contiguous vertical edge surfaces 82*b* so as to form an opening in the front wall 82 for receipt of the pump mechanism as will be subsequently described.

Figure 9:
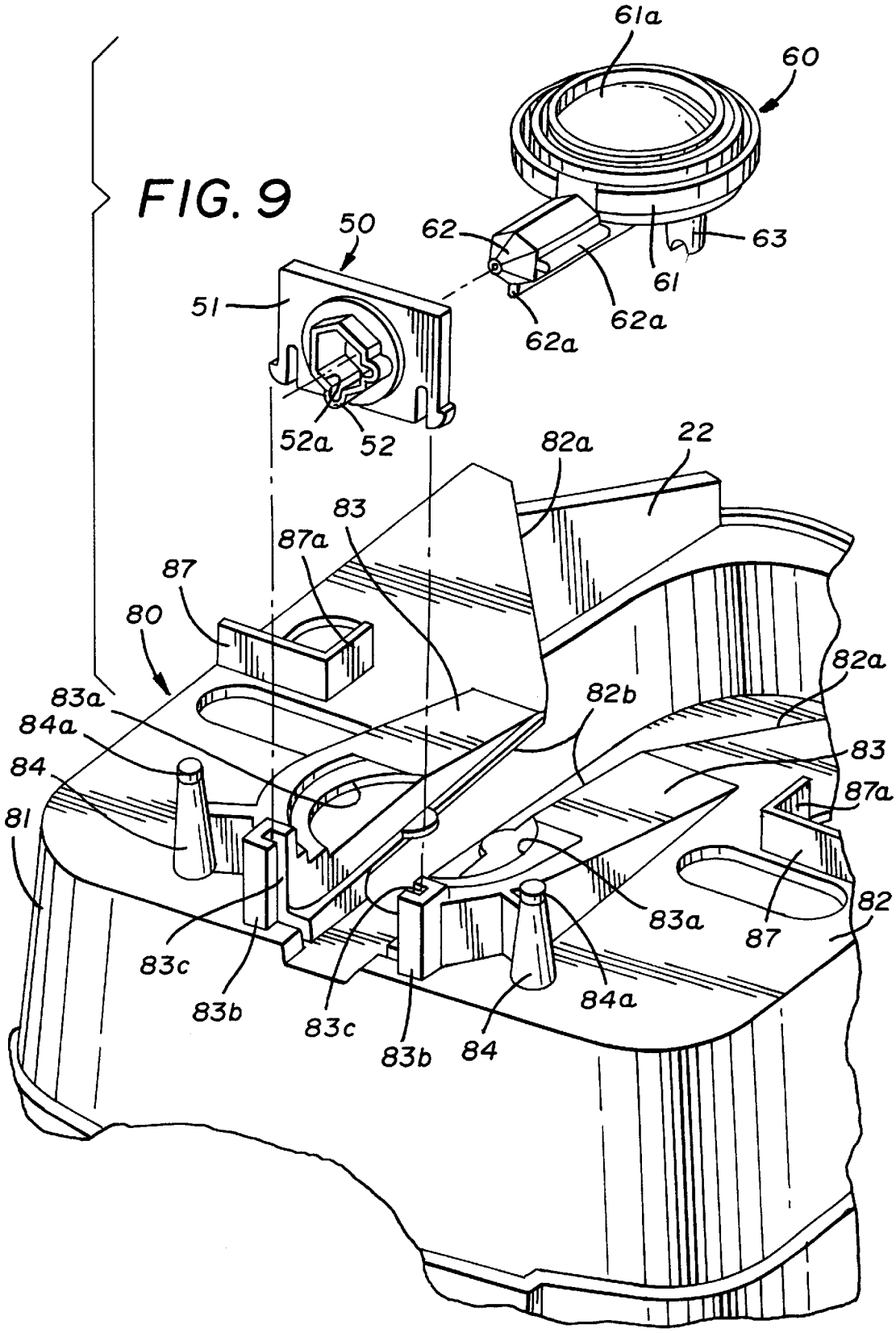
FIG. 9 is an exploded view showing the nozzle, key plate and pump.
Figure 10:
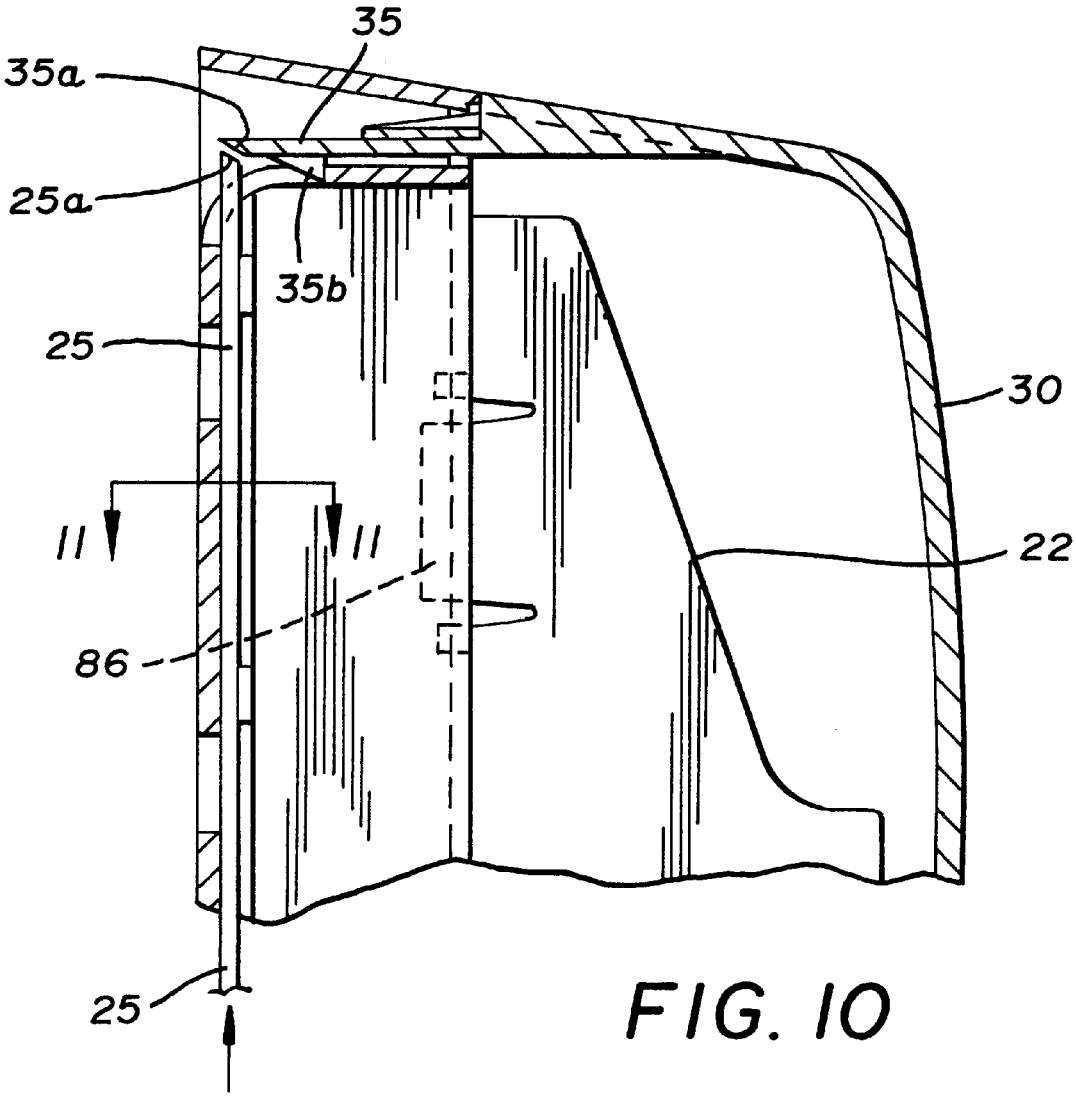
FIG. 10 is a partial sectional view taken along the line 10—10 of FIG. 4 showing the latching mechanism.
Figure 11:
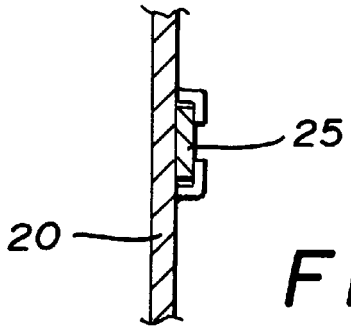
FIG. 11 is a sectional view taken along the line 11—11 of FIG. 10.

Referring particularly next to FIG. 9 of the drawings, it will be seen that a projecting ramp 83 projects from each portion of the forward wall 82, sloping outwardly away from the front wall 82 of bag retainer 80 so as to create a wedge-shaped appearance. These ramps each have an arcuate, recessed area 83*a* adjacent its bottom end.

The ramps 83 each terminate in a slotted rib 83*b* with an elongate slot 83*c* therein and with the ribs projecting outwardly and away from the front wall 82.

Also disposed on the front wall 82 are projecting control posts 84 which each receive, in their distal ends, a removable stop member 84*a*.

Referring to FIGS. 3, 4, 5, 6, 8 and 12, it will be seen how the main components of the dispenser can be readily assembled. Thus, the cover 30 has a fixed integral cross bar 33 adjacent its bottom edge, while the back plate 20 has spaced hook-like members 22 on its bottom edge. These hook members merely snap over the cross bar to interconnect the back plate 20 and cover 30. Similarly, the bag retainer and pump support 80 has a C-shaped member 85 on its lower edge which engages the cross bar 33 following which the bag retainer and pump support 80 has its locking lugs 86, 86, which depend from its sidewalls 81, snapped into the receiving notches 23, 23 in the walls of base plate 20. It will be noted that there is no conventional hinge pin as such and that, when thus assembled, the dispenser 10 is nearly tamper proof.

Figure 8:
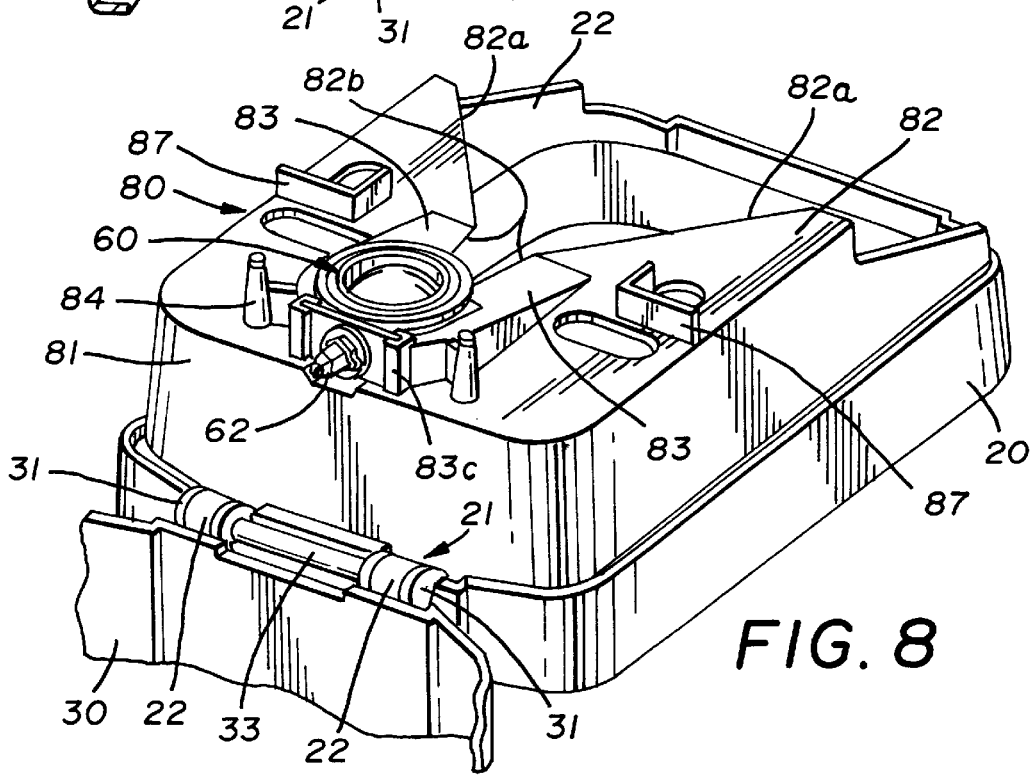
FIG. 8 is a partial enlarged perspective view of the back plate and partial depiction of the cover.

Turning next to FIGS. 7, 8 and 9 of the drawings for a description of the refill or cartridge assembly, it will be seen that a pump 60 is attached by means of a fitment 63 to the collapsible bag B on its front surface adjacent its lower end. This pump is in fluid communication with the interior of the bag B through fitment 63 and has a dispensing nozzle 62 projecting from the main body 61 of pump 60 for communication with the atmosphere. A collapsible and transparent dome 61*a* made of flexible material is also secured to the body 61 in fluid tight condition so as to form, with main body 61, a chamber for receipt of a charge of material from collapsible bag B. It will be noted that when the dispenser has the cover 30 in the closed position shown, for example, in FIG. 7, the clear transparent end wall 42*a* of portion 42 of the pressure or push bar 40 overlies the collapsible dome 61*a* with its concave surface mating with the convex surface of the dome 61*a* in the uncollapsed position.

The pump assembly 60 also includes appropriate valve means disposed adjacent fitment 63 and nozzle 62 with the valve in fitment 63 being-normally open to the bag B and the one in nozzle 62 normally closed. Depression or collapse of the dome 61*a* by actuation of the pressure or push bar 40 will provide pressure on the valve in fitment 63 to close it and permit the valve in nozzle 62 to open, permitting discharge of the material contained in the chamber formed by the dome 61*a* and body 61 to be expelled through nozzle 62. Release of pressure on resilient dome 61*a* permits it to return to its expanded condition and reverses the valve action to permit refilling of the chamber.

It will be apparent then that movement of the pressure or push bar 40 toward the back plate 20 will cause frustoconical portion 42 to collapse the dome, which is supported by bag retainer and pump support 80, thus closing off valve means (not shown) in the fitment 63 and opening valve means (not shown) in the nozzle 62 and permitting a quantity of material to be discharged from the nozzle 62 to the hand of the user.

It will be readily understood that release of the push bar 40 will permit it to return to the position of FIG. 7, closing the valve in the nozzle and opening the valve in the fitment 63 and providing enough suction to draw material from bag B to permit the chamber formed by the body 61 and collapsible dome 61*a* of the pump 60 to refill.

In assembling the combination of the present invention, it will be seen that a key plate 50 is provided. This key plate 50 is sized so that it will fit within the grooves 83*c*, 83*c* of the slotted ribs 83*b*, 83*b*, as shown particularly in FIGS. 8 and 9 of the drawings. The key plate 50 is a generally flat piece with a projection 52 extending from one face thereof and having a through opening 52*a* therein. It will be noted from the drawings that the nozzle 62 has projecting ribs 62*a*, 62*a* arranged in a predetermined and spaced disposition with respect to each other so as to simulate a key. It will further be noted that the opening 52*a* in the projection 52 of the key 50 has a complemental contour so that the nozzle will fit snugly in the opening 52*a*, as can be seen, for example, in FIG. 8 of the drawings.

Inasmuch as various products are dispensed from dispensers of this type, it is contemplated that a user dispensing a given product will be provided with a key plate 50 contoured so that the bags containing that product will be provided with a complementally configured nozzle 62 and, in that fashion, it will be impossible to insert the wrong refill cartridge or bag B into the dispenser without changing key plate 50. This complemental configuration will also insure, along with the arcuate recesses 83*a* in the ramps 83, accurate and secure seating of pump 60 and support therefor when the dome is being collapsed.

Reference has previously been made to the control posts 84 and the replaceable stop members 84*a*. It will be noted that these project from the forward face of the forward wall 82 of the bag retainer 80, and when the dispenser is in the closed position, it will be apparent that, as the push bar 40 is depressed toward back plate 20, it will encounter or engage, at some point, with the stop members 84*a*. This will control the degree to which the push bar can be pushed inwardly toward the back plate 20 and, therefore, control the amount of collapse imparted to the dome 61*a*. It will be understood that the stops 84*a* are replaceable and, depending upon the length chosen for the stops, it will be possible to control the amount of collapse of the collapsible dome member 61*a* and thus the amount of product dispensed with each depression of the push bar.

Figure 12:
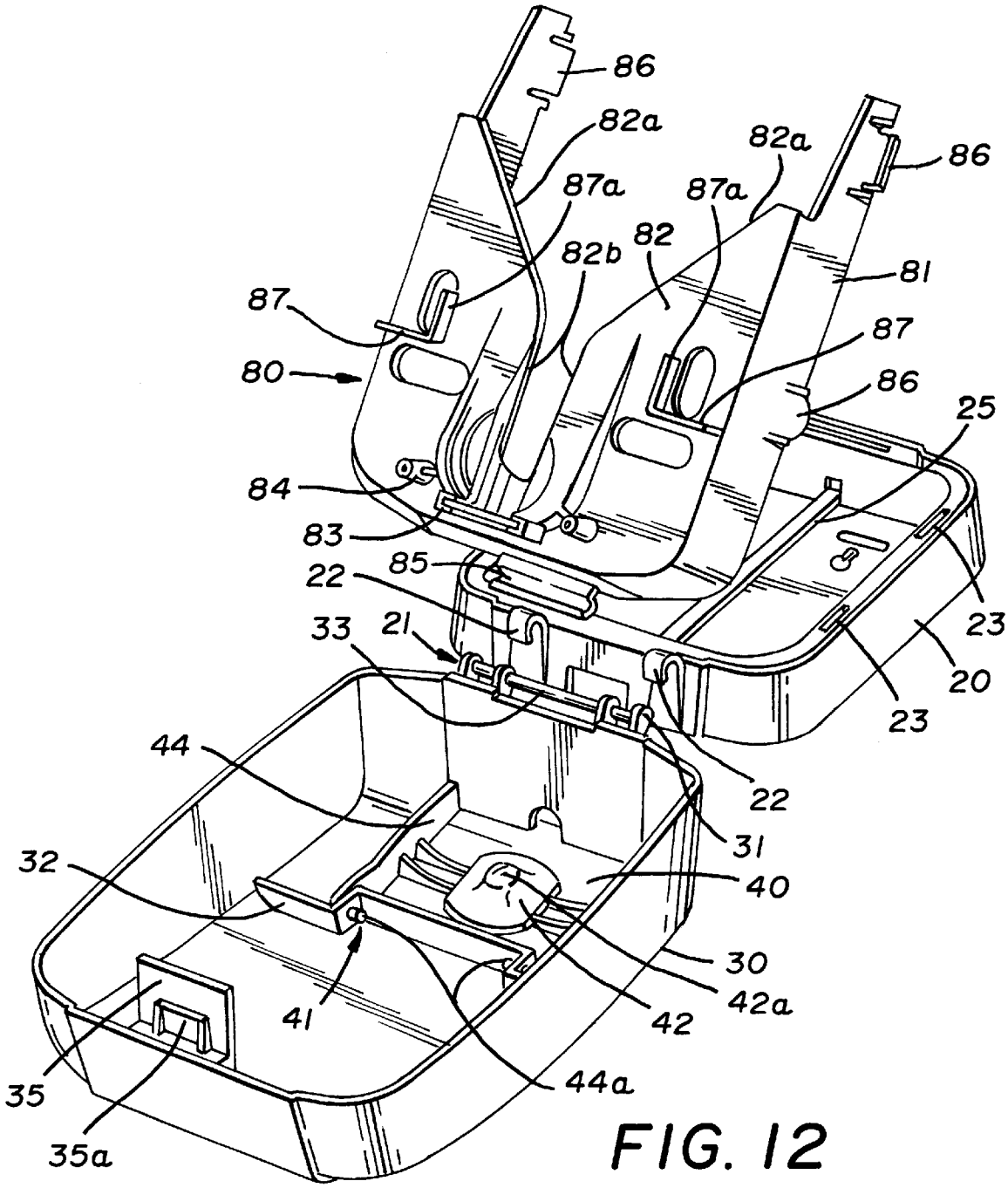
FIG. 12 is an exploded view showing the hinge interconnection between the back plate, cover, push bar and bag retainer.

A further security feature can be seen in FIG. 12 of the drawings. As previously noted, pressure or push bar 40 is simply hingedly attached to the cover 30 by snapping stub shafts 44*a* into support bar 32. When the cover is in the closed position of, for example, FIG. 1, it will be apparent that the pressure or push bar could be easily removed. However, bag retainer and pump support 80 has opposed, spaced, L-shaped ribs 87*a* projecting from the front wall 82. The spacing between these ribs is such that, when the cover is closed, the legs 87*a* thereof will lie along the walls 44 and prevent removal of the pressure or push bar 40 from the outside.

A simplified, unique latching arrangement is also provided to secure cover 30 in the closed position. The back plate 20 carries a slidable actuator 25, as can be seen in FIGS. 4, 5, 10, 11 and 12. This actuator has its lower end accessible from the bottom of dispenser 10 when the cover is closed (see FIG. 4). Its upper end has a beveled surface 25*a*. The cover 30 has a flexible lip 35 at its top which also has a mating beveled surface 35*a* on its leading edge. This lip overlies the opposed end of actuator 25 (see FIG. 10) and has an engagement wedge 35*b* for engagement with back plate 20. Thus, when the cover is closed, the wedge 35*b* snaps into place and locks the cover 30 to back plate 40. Moving slidable actuator 25 upwardly causes the beveled surfaces 25*a* and 35*a* to engage flexing lips 35 out of engagement with back plate 20 and, thus, unlocks cover 30.

While a full and complete description of the invention has been set forth in accordance with the dictates of the patent statutes, it should be understood that modifications can be resorted to without departing from the spirit hereof or the scope of the appended claims.

What is claimed is:

1. A dispenser for dispensing liquids from a collapsible bag, the bag having a pump attached thereto, comprising:

a) a back plate;

b) a cover hingedly attached to said back plate for movement between open and closed positions with respect thereto;

c) bag retaining and pump support means carried by said back plate for receiving the collapsible bag and providing support for the pump;

d) said bag retaining and pump support means having a front wall and a bottom wall, said front wall providing a pump support surface and said bottom wall providing a support surface for the collapsible bag; and e) pressure means carried by said cover for actuating the pump.

2. The dispenser of claim 1 wherein the pump is located on the front surface of the bag.

3. The dispenser of claim 1 wherein said bottom wall projects outwardly from said back plate toward said cover; and opposed side panels projecting outwardly from said back plate toward said cover and lying in a plane substantially normal to the plane of said bottom wall.

4. The dispenser of claim 1 wherein adjustable stop means are disposed on said bag retaining and pump support means and project toward said cover when said cover is in its closed position.

5. The dispenser of claim 1 wherein latching means are carried on said cover and said back plate for securing said cover in its closed position.

6. A dispenser for dispensing liquids from a collapsible bag, the bag having a pump attached thereto, comprising:

a) a back plate;

b) a cover hingedly attached to said back plate for movement between open and closed positions with respect thereto;

c) bag retaining and pump support means carried by said back plate for receiving the collapsible bag and providing support for the pump; and d) pressure means carried by said cover for actuating the pump wherein the pump includes a transparent collapsible dome.

7. The dispenser of claim 1 wherein said pressure means includes a pressure bar, hingedly connected to said cover and overlying the pump when said cover is in its closed position.

8. A dispenser for dispensing liquids from a collapsible bag, the bag having a pump attached thereto, comprising:

a) a back plate;

b) a cover hingedly attached to said back plate for movement between open and closed positions with respect thereto;

c) bag retaining and pump support means carried by said back plate for receiving the collapsible bag and providing support for the pump; and d) pressure means carried by said cover for actuating the pump, said pressure means including a pressure bar hingedly connected to said cover and overlying the pump when said cover is in its closed position, wherein the pump includes a transparent collapsible dome and said pressure bar includes a transparent window for engagement with said clear transparent dome.

9. A dispenser for dispensing liquids from a collapsible bag, the bag having a pump attached thereto, comprising:

a) a back plate;

b) a cover hingedly attached to said back plate for movement between open and closed positions with respect thereto;

c) bag retaining and pump support means carried by said back plate for receiving the collapsible bag and providing support for the pump;

d) pressure means carried by said cover for actuating the pump;

e) pump positioning means disposed on said front wall of said bag retaining and pump support means; and f) a keyed fitment for engagement with said pump positioning.

10. The dispenser of claim 8 wherein said front wall has an elongate central opening extending toward said bottom wall and substantially centered between said side walls.

11. The dispenser of claims 9 or 10 wherein said pump positioning means are removably carried by said front wall of said bag retaining and pump support means.

12. The dispenser of claim 11, wherein said pump positioning means include a plate having a central keyed opening therethrough; said keyed opening being contoured to complement the contour of said fitment.

13. A dispenser for dispensing liquids from a collapsible bag having a pump attached thereto, comprising:

a) a back plate;

b) a cover hingedly attached to said back plate for movement between open and closed positions;

c) a bag retainer and pump support attachable to said back plate for receiving the collapsible bag;

d) pressure means carried by said cover for actuating the pump; and e) said pump including a body and a collapsible dome selectively attachable to the bag on its front surface adjacent its bottom edge.

14. The dispenser of claim 13 wherein said bag retainer and pump support includes a central locating device for receipt of the pump.

15. The dispenser of claim 14 wherein said cover has a support bar disposed on its interior surface; said pressure means hingedly attached to said support bar; and said bag retainer and pump support carries projecting abutment means for engaging and securing said pressure member against removal from the exterior when said cover is in its closed position.

16. The dispenser of claim 13 wherein said bag retainer and pump support has a front wall; and at least one replaceable stop projecting from said front wall toward said pressure means when said cover is in its closed position.

17. The dispenser of claim 13 wherein said front wall has retaining means carried by and projecting from said front wall; and locating means receivable in said retaining means.

18. The dispenser of claim 13 wherein latching means are carried on said cover and said back plate for securing said cover in its closed position.

19. A dispenser for dispensing liquids from a collapsible bag having a pump attached thereto, comprising:

a) a back plate;

b) a cover hingedly attached to said back plate for movement between open and closed positions;

c) a bag retainer and pump support attachable to said back plate for receiving the collapsible bag, said bag retainer and pump support having a front wall including an elongate central opening and a pair of opposed inclined ramps projecting from said from wall and disposed on opposite sides of said elongate central opening, each of said inclined ramps having a contoured recessed area for receipt of the pump;

d) pressure means carried by said cover for actuating the pump; and e) said pump including a body and a collapsible dome attached to the bag on its front surface adjacent its bottom edge.

20. The dispenser of claim 19 wherein said front wall has retaining means carried by and projecting from said front wall; and locating means receivable in said retaining means.

21. A dispenser for dispensing liquids from a collapsible bag having a pump attached thereto, comprising:

a) a back plate;

b) a cover;

c) a bag retainer and pump support;

d) said cover having a transverse pivot bar adjacent its lower edge;

e) said back plate having, hook-like connectors adjacent its bottom edge for releasable engagement with said pivot bar; and f) said bag retainer and pump support having an engagement member adjacent its bottom edge for releasable engagement with said pivot bar whereby said back plate, said cover and said bag retainer and pump support may be assembled with said cover hingedly attached to said back plate for movement between open and closed positions.

22. The dispenser of claim 21 wherein latching means are carried on said cover and said back plate for securing said cover in its closed position.

23. The dispenser of claim 22 wherein said latching means include an elongate actuator slidably received on said back plate; and a flexible lip received on said cover adjacent its top edge for releasable engagement with one end of said elongate actuator.

24. A dispenser for dispensing liquid from a collapsible bag, comprising:

a) a back plate for receiving the collapsible bag;

b) a collapsible dome-type pump attachable to the collapsible bag on the front surface thereof adjacent the bottom edge thereof;

c) a cover attached to said back plate for movement between open and closed positions with respect thereto;

d) said pump being provided with a transparent collapsible dome member; and e) said pump being located adjacent the bottom of said back plate when the bag is received thereon.

25. The dispenser of claim 24 wherein a pressure bar for actuating said pump is carried by said cover; and said pressure bar includes a transparent window positioned in overlying relationship with said transparent collapsible dome member when said cover is in its closed position.

26. A dispenser for dispensing liquids from a collapsible bag, the bag having a pump attached thereto, comprising:

a) a back plate;

b) a cover hingedly attached to said back plate for movement between open and closed positions with respect thereto;

c) bag retaining and pump support means carried by said back plate for receiving the collapsible bag and providing support for the pump;

d) the pump including a transparent collapsible dome; and e) pressure means carried by said cover for actuating the pump.

* * * * *